United States Patent [19]

Burkhart

[11] 4,076,582

[45] Feb. 28, 1978

[54] SUCTION ROLL SEALING STRIP CLEANING STRUCTURE

[75] Inventor: James H. Burkhart, Monroe, Ohio

[73] Assignee: Diamond International Corporation, New York, N.Y.

[21] Appl. No.: 784,311

[22] Filed: Apr. 4, 1977

[51] Int. Cl.[2] ..... D21F 3/10

[52] U.S. Cl. ..... 162/272; 162/371; 162/372

[58] Field of Search ..... 162/199, 272, 274, 276, 162/279, 306, 357, 369, 370, 371, 372; 29/121.4, 121.5, 121.6, 121.7; 15/306 A

[56] References Cited

U.S. PATENT DOCUMENTS

| | | | |
|---|---|---|---|
| 1,867,930 | 7/1932 | Traquair | 162/370 X |
| 2,893,487 | 7/1959 | Dahl et al. | 162/371 |
| 3,562,883 | 2/1971 | Kobayashi | 162/372 X |

FOREIGN PATENT DOCUMENTS

| | | | |
|---|---|---|---|
| 542,034 | 10/1954 | Belgium | 162/369 |

*Primary Examiner*—Richard V. Fisher
*Attorney, Agent, or Firm*—Karl W. Flocks

[57] ABSTRACT

A self-cleaning suction roll assembly of the type comprising a generally cylindrical shell having an outer radial surface, an inner radial surface and perforations formed in the shell extending from the outer radial surface to the inner radial surface. The assembly includes a plurality of sealing elements for forming a pressure chamber or compartment with the inner surface of the shell, against which such sealing elements are in engagement in the operation of the assembly. The cylindrical shell is provided with recess or recesses formed on the inner surface across the length thereof whereby fibers and other deleterious material which manage to pass through the perforations may be continuously swept into such recess or recesses and carried out of the pressure chamber or compartment and washed out in normal operation of the assembly so that such fibers and other material will not accumulate against the sealing elements inside the pressure chamber or compartment.

14 Claims, 17 Drawing Figures

SUCTION ROLL SEALING STRIP CLEANING STRUCTURE

BACKGROUND OF THE INVENTION

1. Field of the Invention

The field of the invention relates to perforated suction rolls of the type used in machinery for manufacturing paper or related products thereof. Rolls of this type include forming cylinders, couch rolls, and the like. More particularly, this invention relates to sealing structure, which in operation of paper making machinery, is pressed against the inside surface of a suction roll while permitting sliding contact between the seal and the rotated roll. Relevant prior art, if any exists, would in applicant's opinion most likely be found in Class 162, Subclasses 48, 272, 274, 276, 279 and 367–372.

2. Description of the Prior Art

Of the prior art known to applicant, U.S. Pat. No. 2,893,487 (Dahl et al) and U.S. Pat. No. 1,867,930 (Traquair) are noted as being of possible relevance. Dahl et al. is of interest in that it relates to suction roll structure including a sealing element having a groove in its working surface, which in operation is pressed against the inside surface of a suction roll associated therewith. The groove in question in the Dahl et al. structure is zig-zag and in use communicates with several holes in the surface of the suction roll. The Traquair patent is of interest in that it discloses a suction roll device assembled from block elements having grooves on the inner surfaces thereof. While there may be some similarities between the roll structures of Dahl et al. and Traquair and that of the instant application, such similarities are believed to be superficial and this will become obvious upon a careful reading and studying of the description and drawings presented herewith.

In the normal use of perforated or drilled suction rolls, fibrous materials handled by suction rolls have a tendency to find their way through the wires on the outer surface, through the perforations and into the inner surface of the roll and if care is not taken to remove such fibrous material, it will in time accumulate in lumps to the extent that it will present an obstacle to proper sealing by pushing the seal out of contact with the roll surface.

SUMMARY OF THE INVENTION

The present invention relates to perforated suction roll structure for use in the manufacture of paper and the sealing structure provided for cooperation with the internal surface of such rolls and has as its principal object the construction of an improved roll and seal arrangement which will continue in use with reduced downtime for cleaning and/or replacement of sealing elements.

It is also an object of this invention to provide an arrangement in which the sealing surfaces of sealing elements are automatically cleaned during operation of the suction roll associated therewith.

It is a further object of this invention to provide a suction roll and sealing arrangement whereby fibrous elements and other deleterious foreign matter finding its way through the perforations of a suction roll, which otherwise would accumulate and build up on the inside surface of the roll to push away the sealing members to reduce the efficiency and/or destroy the efficacy thereof, may be automatically removed during the operation of the suction roll to maintain longer continuous operation with reduced periods of roll cleaning and seal adjustment and/or replacement.

DETAILED DESCRIPTION OF THE INVENTION

Figure 3:
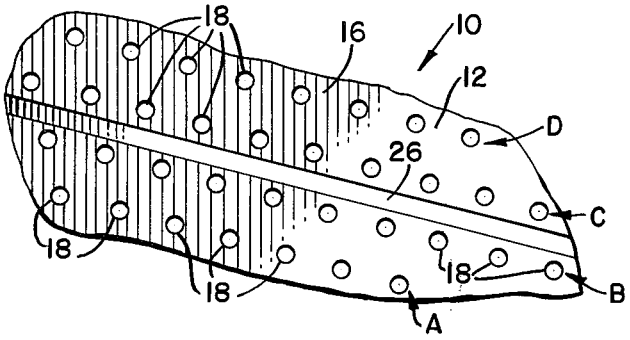
FIG. 3 is a fragmentary view on an enlarged scale taken along the line 3—3 and looking down in the direction of the arrows in FIG. 2.
Figure 4:
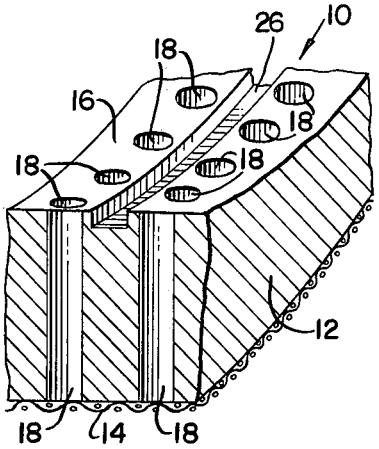
FIG. 4 is a view in perspective of the structure of FIG. 3 looking in the direction of a groove on a further enlarged scale.
Figure 5:
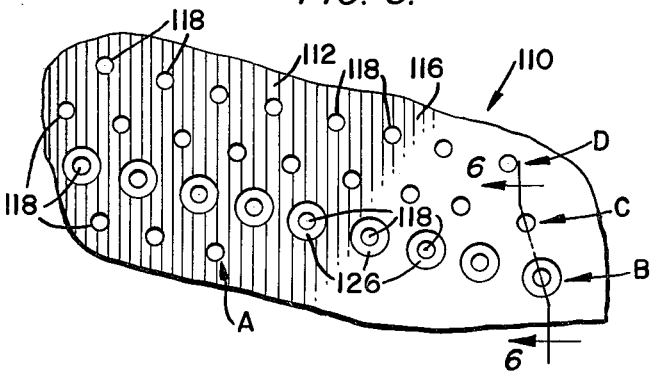
FIG. 5 is a view similar to FIG. 3, but of an alternative embodiment of the present invention.
Figure 6:
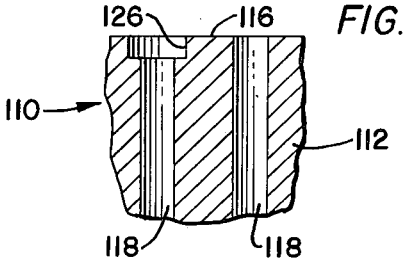
FIG. 6 is a view taken along the line 6—6 in FIG. 5 and looking in the direction of the arrows.
Figure 7:
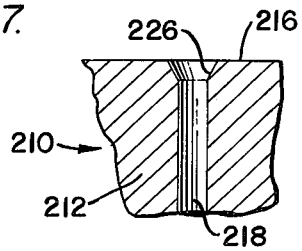
FIG. 7 is a view similar to FIG. 6 of yet another embodiment of the present invention.
Figure 8:
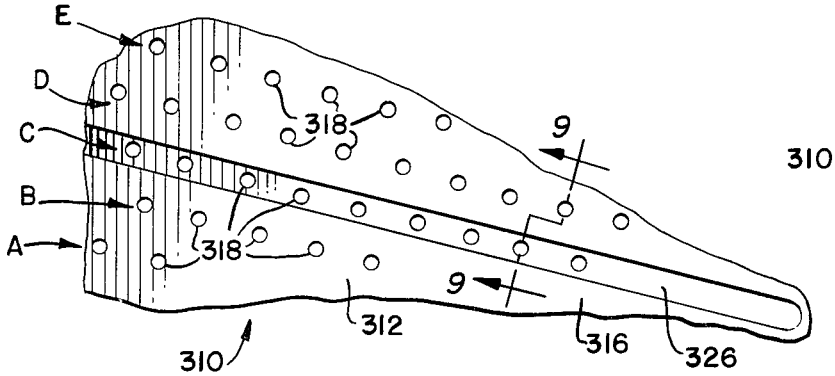
FIG. 8 is yet another view similar to FIG. 3 of a further embodiment of the present invention.
Figure 9:
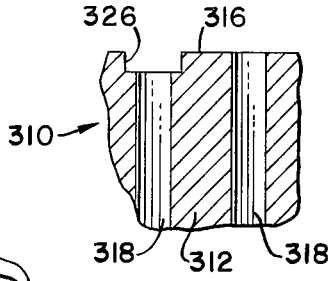
FIG. 9 is a view taken along the line 9—9 in FIG. 8 and looking in the direction of the arrows.
Figure 10:
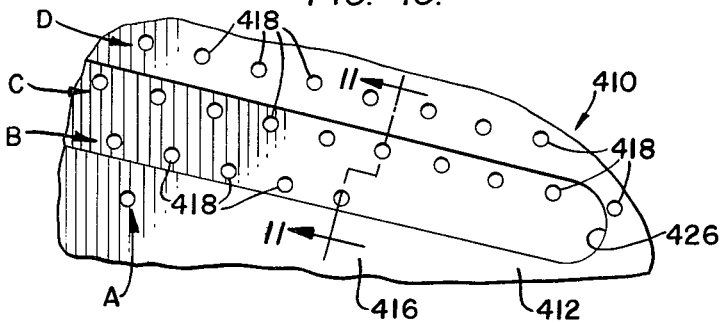
FIG. 10 is another view similar to FIG. 3 of a further embodiment of the present invention.
Figure 11:
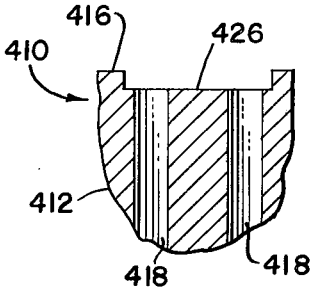
FIG. 11 is a view taken along the line 11—11 in FIG. 10 and looking in the direction of the arrows.
Figure 12:
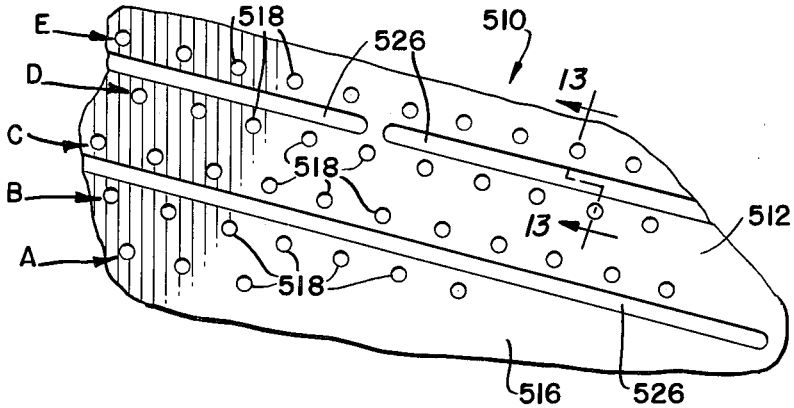
FIG. 12 is yet a further view similar to FIG. 3 of still another embodiment of the present invention.
Figure 13:
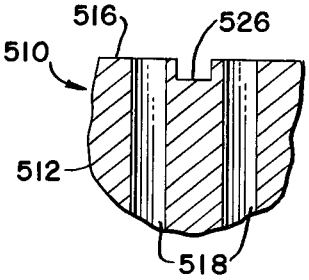
FIG. 13 is a view taken along the line 13—13 in FIG. 12 and looking in the direction of the arrows.
Figure 14:
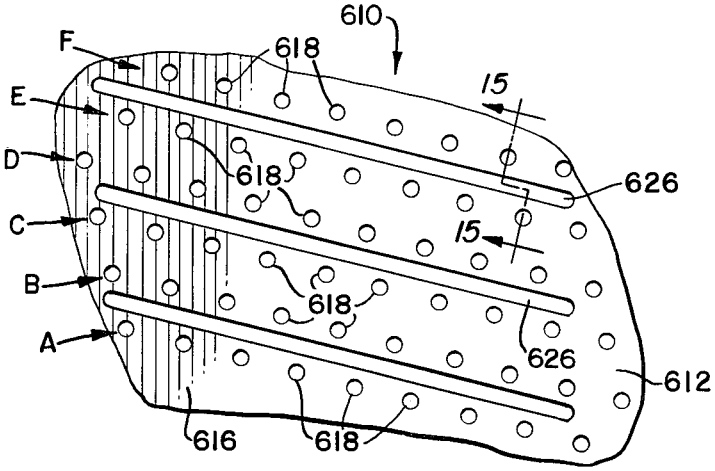
FIG. 14 is yet another view similar to FIG. 3 of a further embodiment of the present invention.
Figure 15:
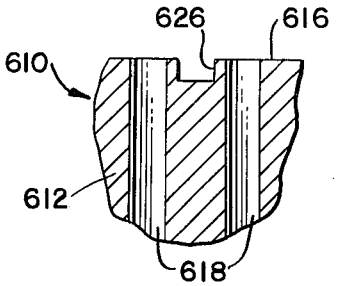
FIG. 15 is a view taken along the line 15—15 in FIG. 14 and looking in the direction of the arrows.

Referring now to the drawings in detail the reader will readily appreciate that FIGS. 1–4 relate to a first embodiment of the inventive concept disclosed herein; FIGS. 5 and 6 relate to an alternative embodiment of the inventive concept; FIG. 7 relates to another embodiment of the inventive concept; FIGS. 8 and 9 relate to still another embodiment of the inventive concept; FIGS. 10 and 11 relate to a fifth embodiment of the invention; FIGS. 12 and 13 relate to a sixth embodiment of the invention; FIGS. 14 and 15 relate to a seventh embodiment of the invention; and FIGS. 16 and 17 relate to an eighth embodiment of the invention. Starting with the embodiment disclosed in FIGS. 1–4 various structural details are designated with an initial set of reference numbers, after which structural details of additional embodiments disclosed herein are designated with similar reference numbers plus 100 in successive embodiments.

Figure 1:
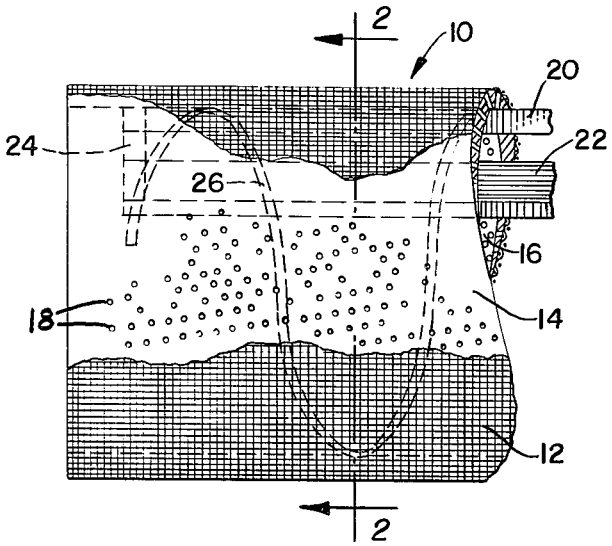
FIG. 1 shows a fragmentary view in elevation of a suction roll and sealing arrangement according to the present invention.
Figure 2:
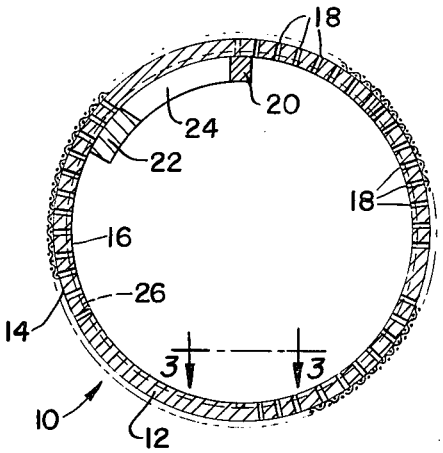
FIG. 2 is a sectional view taken along the line 2—2 in FIG. 1 and looking in the direction of the arrows.

Considering now the inventive concept as embraced by the embodiment of FIGS. 1–4, the reader will readily see that a suction roll assembly 10 is disclosed as including a generally cylindrical hollow shell 12 having an outer radial surface 14 and an inner radial surface 16. The shell 12 is formed with a plurality of groups A, B, C, D, etc. of passages in the form of perforations 18 extending from the outer radial surface 14 to the inner radial surface 16. The perforations 18 of each group A, B, C, D, etc. extend from one end of shell 12 to the other end in a particular pattern, for example, in an helical path in the embodiment of FIGS. 1–4. The helical path of the various groups A, B, C, D, as is consistent with conventional practice, are spaced-apart from each other and do not cross. Consistent with suction roll devices of the known prior art, the suction roll assembly 10 of the present invention is supported for rotation in operation thereof. As may also be known in the prior art, sealing means are provided in the interior of shell 12 and are disposed in a fixed location and pressed against the inner surface 16 in sealing engagement thereagainst as the shell is rotated in operation thereof whereby a sweeping effect between the sealing means and the inside surface 16 is effected. The sealing means as disclosed in the embodiment of FIGS. 1–4 comprises a first longitudinally extending sealing element 20, a second longitudinally extending sealing element 22 spaced apart from the first sealing element 20, a third sealing element 24 extending in a circumferential direction to connect adjacent ends of sealing elements 20 and 22. An additional sealing element which is not shown should be understood to connect the other ends of sealing elements 20 and 22 to form a pressure chamber or compartment. A wire or screen surrounds the shell of a suction roll in the case of a forming cylinder. In FIG. 1 such a wire or screen, which is unnumbered, is partially broken away to expose the outer surface 14 of shell 12 through which numerous perforations 18 extend. The space enclosed between sealing elements 20, 22, 24 and a further sealing element at the remote ends of sealing elements 20, 22 from sealing element 24 is understood as an enclosed chamber or compartment in which suction, for example, may be applied in the course of a paper-making process. Notwithstanding the control of suction in a vacuum chamber and the presence of a wire on the surface of a suction roll, fibers of pulp or the like and other material have a tendency to pass through the wire, the perforations and into the vacuum chamber such as between sealing elements and accumulate therein. Ordinarily, such fibers and other material would build up on the inner surface 16 in the vacuum chamber between sealing elements 20, 22, 24 and the further sealing element at the opposite ends of sealing elements 20, 22 from sealing element 24 and be trapped within such chamber due to the wiping or sweeping effect between the inner surface 16 and the sealing elements 20, 22 as the shell 12 is rotated. Such fibers and other deleterious material which may include resins, after a period of time, build up to flakes and thereafter lumps which become rather hard and require down time for cleaning and removal, as otherwise such material increases friction between seals and shell surface, push seals away from shell surface, and may even tear up the sealing elements. Where the build-up of material causes increase in friction between seals and shell surface, greater power may be required to rotate the roll. It can be readily appreciated that where the material builds up to the point of finding its way between the sealing surface and the inside surface of the shell, the sealing effect and the pressure chamber provided thereby are lost. If beyond this the material hardens and adheres to the inside surface 16 of the shell 12 it can tear up the sealing elements 20, 22 in a short period of time if the roll is operated.

With the formation of recess means on the inner surface 16 of shell 12 extending at least as long as the length of shell 12 any material finding its way through the wire and/or perforations 18 are in operation of suction roll assembly 10 automatically wiped or swept into such recess means, which as illustrated is a groove 26. The groove 26 as illustrated in FIGS. 3 and 4 are formed in a pattern between groups B and C of perforations 18. As may be seen in FIG. 3 there are many groups A, B, C, D, etc. of perforations 18 in the shell 12 with all such groups being spaced from each other and not crossing. The groove 26 as is seen in FIG. 1 is to be understood as being in an helical pattern from one end of shell 12 to the other end thereof, and consequently each group A, B, C, D, etc. of perforations are to be understood to be in helical patterns, all of the same pitch and not crossing. The groove 26 as disclosed is continuous from one end to the other. After a portion of the shell 12 having a portion of groove 26 formed therein passes between sealing elements 20, 22 and from between sealing elements 20, 22 with fibers or other material being wiped or swept into the passing portion of groove 26, such portion of groove 26 may then be moved past a spray or other cleaning means to remove the fibers or other material whereby a vacuum chamber or compartment is in operation of the disclosed invention continuously cleaned.

An alternative embodiment of the invention is illustrated in FIGS. 5 and 6 wherein a suction roll 110 comprises a shell 112 with an inner surface 116. The shell 112 is formed with a plurality of groups A, B, C, D, etc. of perforations 118 which permit suction, for example, to be applied to the outer surface from a chamber within shell 112. To facilitate removal of fibers and other deleterious material from the region of a suction chamber recess means are formed in the inner surface 116 of shell 112 in a pattern spaced apart from and between that of patterns A and C, but along the path of pattern B of perforations 118. The recess means along the path of pattern B comprise a plurality of cylindrical countersunk portions 126 at and around the inner ends of perforations 118.

FIG. 7 shows an embodiment of the invention wherein suction roll assembly 210 comprises a shell 212 having perforations 218 extending therethrough with conical countersunk portions 226 formed on inner ends of perforations 218 at the inner surface 216 in a manner similar to that of the embodiment of FIGS. 5 and 7.

In yet another embodiment of the present invention FIGS. 8 and 9 relate to a suction roll 310 comprising a shell 312 with a plurality of groups A, B, C, D, E, etc. of perforations 318 of which the groups are spaced apart from each other without crossing. The perforations 318 extend through the shell 312 and have at the inner ends of one group recess means for receiving fibers and other deleterious material. As is clearly illustrated the recess means is in the form of a groove 326 on the inner surface 316 of shell 312. Groove 326 extends along the pattern of group C perforations 318 and surrounds the inner ends of such perforations 318. Groove 326 may also be observed to be extending between the pattern of groups B and D.

FIGS. 10 and 11 relate to a further embodiment of the invention in which suction roll 410 comprises a shell 412 having a plurality of groups A, B, C, D, etc. of perforations 418 formed therein. Recess means for receiving fibers and other deleterious material is formed on the inner surface 416 of shell 412 as a groove 426 between the patterns of groups A and D perforations 418 but extending continuously over the patterns of groups B and C and surrounding the inner ends of groups B and C perforations 418.

FIGS. 12 and 13 relate to yet a further embodiment of the invention wherein suction roll 510 comprises a shell 512 having a plurality of groups of perforations 518 in patterns A, B, C, D, E, etc. formed in a shell 512. Recess means for receiving fibers and other deleterious material is formed as a plurality of grooves 526 on the inner surface 516 of shell 512 in an intermittent pattern. Grooves 526 are formed as intermittent segments disposed between groups of perforations 518 between patterns B and C and between pattenrs D and E.

In FIGS. 14 and 15 a further embodiment of the invention is illustrated with suction roll assembly 610 including a shell 612 provided with a plurality of groups of perforations 618 with recess means in herringbone pattern. The recess means includes a plurality of grooves 626, only three of which are illustrated, formed on the inner surface 616 of shell 612 and extending between groups of perforations 618 in patterns A and B, in patterns C and D, and in patterns E and F.

Figure 16:
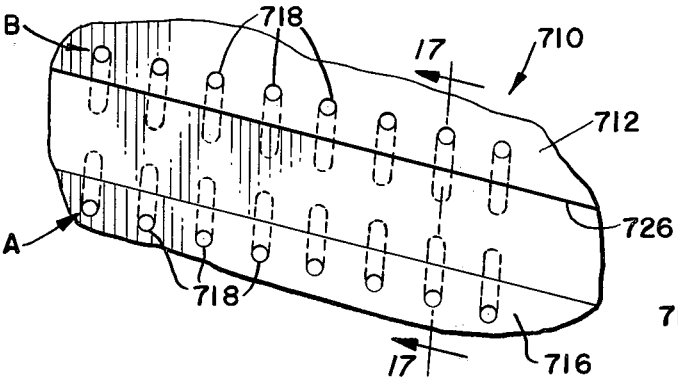
FIG. 16 is another view similar to FIG. 3 of a further embodiment of the present invention.
Figure 17:
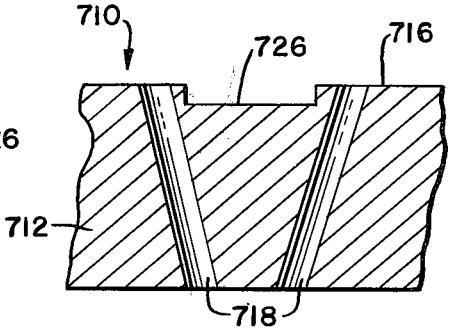
FIG. 17 is a view taken along the line 17—17 in FIG. 16 and looking in the direction of the arrows.

In a further embodiment of the present invention a suction roll assembly 710 includes a shell 712, as illustrated in FIGS. 16 and 17 having a plurality of groups of perforations 718 in spaced-apart patterns A and B. The spacing between the inner ends of perforations 718 of pattens A and B is greater than that between the outer ends of perforations 718 of patterns A and B in the sense that the perforations 718 in pattern A diverge from the perforations 718 in pattern B as the perforations extend from their outer ends toward the inner surface 716 of shell 712. To facilitate removal of fibers and/or other material from the confines of sealing elements, recess means in the form of a channel or groove 726 is formed on inner surface 716. The groove 726 while lying between the inner ends of perforations 718 in patterns A and B is wider than the space between outer ends of perforations 718 in patterns A and B.

From the foregoing disclosure, applicant has disclosed groove or channel structure on the inner surface of a suction roll to facilitate removal of foreign materials from between the confines of sealing elements in a continuous cleaning process during operation of the suction roll. Cleaning may be carried out by passage of air or water through the groove or channel and the sealing elements. Further, cleaning of the channel or groove may also be accomplished by spraying when such channel or groove has moved out of the confines of the sealing elements. Also, as disclosed, the grooves may be formed over the perforations or on the lands between the perforations. In practice the dimensions of the groove may be designated so that its depth is to be no more than half the width thereof so that material may be easily flushed therefrom.

It will be obvious to those skilled in the art that various changes may be made without departing from the scope of the invention and the invention is not to be considered limited to what is shown in the drawings and described in the specification.

What is claimed is:

1. A self-cleaning suction roll assembly comprising a generally cylindrical shell having an outer radial surface, an inner radial surface, means defining groups of passages extending from said outer surface to said inner surface, and sealing means disposed within said shell and extending both longitudinally and circumferentially of said shell to define a pressure zone, said sealing means in operation of said suction roll assembly being in sealing engagement against said inner surface and secured at a fixed location whereby as said shell is rotated a sweeping action is effected between said inner surface of said shell and said sealing means, each of said groups of passages including a plurality of perforations formed in generally similar geometric patterns spaced-apart from each other in said shell, said shell also having recess means formed in said inner surface for reception and removal of fibers and/or other deleterious matter finding their way through said perforations and into said pressure zone, said recess means being formed in said inner surface in a pattern generally similar to that of the perforations of each of said groups of passages.

2. The suction roll assembly according to claim 1 wherein the pattern of said recess means extends alongside the pattern of two or more of said groups of passages.

3. The suction roll assembly according to claim 2 wherein the pattern of said recess means is disposed between only one pair of said groups of passages.

4. The suction roll assembly according to claim 3 the respective patterns of said groups of passages and said recess means are formed in spaced-apart helical paths in said shell.

5. The suction roll assembly according to claim 2 wherein the perforations in one of said groups and the perforations of another of said groups adjacent thereto diverge from each other from the outer surface of said shell to the inner surface thereof with said recess means being in the form of a groove lying between said adjacent groups of passages on the inner surface of said shell.

6. The suction roll assembly according to claim 2 wherein said recess means comprise intermittent grooves extending between a pair of said groups of passages on the inner surface of said shell.

7. The suction roll assembly according to claim 6 wherein said recess means also comprise grooves extending between more than one pair of said groups of passages on the inner surface of said shell.

8. The suction roll assembly according to claim 7 wherein said groups of passages and said recess means are formed in said shell in herring bone pattern with said recess means including a plurality of grooves between adjacent pairs of said groups of passages.

9. The suction roll assembly according to claim 2 wherein the pattern of said recess means are coincident with at least one of said groups of passages on the inner surface of said shell.

10. The suction roll assembly according to claim 9 wherein said recess means are formed on the inner surface of said shell as individual countersunk portions around the inner end of the perforations of one of said groups of passages.

11. The suction roll assembly according to claim 10 wherein said countersunk portions are cylindrical.

12. The suction roll assembly according to claim 10 wherein said countersunk portions are conical.

13. The suction roll assembly according to claim 9 wherein said recess means comprise a groove on the inner surface of said shell extending continuously along the pattern of one of said groups of passages and around the inner ends of the perforations of said passages.

14. The suction roll assembly according to claim 9 wherein said recess means comprise a group on the inner surface of said shell extending continuously along the pattern of at least an adjacent pair of said passages and around the inner ends of the perforations of said adjacent pair of passages.

* * * * *